US009929504B2

(12) United States Patent
Bauer et al.

(10) Patent No.: US 9,929,504 B2
(45) Date of Patent: Mar. 27, 2018

(54) ELECTRICAL CIRCULAR PLUG-IN CONNECTOR HAVING A PUSH-PULL LOCKING MECHANISM

(71) Applicant: PHOENIX CONTACT CONNECTOR TECHNOLOGY GMBH, Herrenberg (DE)

(72) Inventors: Peter Bauer, Schönaich (DE); Markus Michel, Nagold (DE); Hrvoje Babic, Reutlingen (DE)

(73) Assignee: PHOENIX CONTACT CONNECTOR TECHNOLOGY GMBH, Herrenberg (DE)

( * ) Notice: Subject to any disclaimer, the term of this patent is extended or adjusted under 35 U.S.C. 154(b) by 0 days.

(21) Appl. No.: 15/123,339

(22) PCT Filed: Feb. 9, 2015

(86) PCT No.: PCT/EP2015/052593
§ 371 (c)(1),
(2) Date: Sep. 2, 2016

(87) PCT Pub. No.: WO2015/132046
PCT Pub. Date: Sep. 11, 2015

(65) Prior Publication Data

US 2017/0018875 A1 Jan. 19, 2017

(30) Foreign Application Priority Data

Mar. 6, 2014 (EP) ..... 14157999

(51) Int. Cl.
*H01R 13/627* (2006.01)
*H01R 13/633* (2006.01)

(52) U.S. Cl.
CPC ..... *H01R 13/6275* (2013.01); *H01R 13/633* (2013.01)

(58) Field of Classification Search
CPC ..... H01R 13/627; H01R 13/6275; H01R 13/6278
(Continued)

(56) References Cited

U.S. PATENT DOCUMENTS 4,846,714 A * 7/1989 Welsby ..... H01R 13/62 285/316
4,941,846 A * 7/1990 Guimond ..... H01R 24/542 439/180
(Continued)

FOREIGN PATENT DOCUMENTS

FR 2949614 A1 3/2011
WO WO 2011/024123 A1 3/2011

OTHER PUBLICATIONS

International Search Report for corresponding International Application No. PCT/EP2015/052593 dated May 7, 2015.

*Primary Examiner* — Vanessa Girardi
(74) *Attorney, Agent, or Firm* — Renner Otto Boisselle & Sklar, LLP

(57) ABSTRACT

The invention relates to an electrical circular plug-in connector having a plug part and a counter-plug part, which can be releasably locked together by means of a push-pull locking mechanism via at least one locking element that extends axially and can be deflected radially, which element is provided with an inwardly protruding detent, to which an outwardly open latching trap is assigned on the counter-plug part. The locking element is integrally molded on a retaining ring, which is immovably mounted on the plug part between the unlocking sleeve and a front hollow cylindrical plug region of the plug part, and which pulls the plug part and the counter-plug part together in a play-free manner by means of a spring force component acting inwardly in a radial direction. According to the invention, a securing sleeve for the locking element is arranged between the retaining ring and
(Continued)

the unlocking sleeve, said securing sleeve being axially displaceable with the unlocking sleeve and acting upon the locking element with radially inward force by means of the spring force of a helical pressure spring.

12 Claims, 5 Drawing Sheets

(58) Field of Classification Search
USPC ..... 439/345, 350, 352, 353
See application file for complete search history.

(56) References Cited

U.S. PATENT DOCUMENTS

| | | | | |
|---|---|---|---|---|
| 7,322,846 | B2 * | 1/2008 | Camelio | H01R 13/6277 439/352 |
| 7,399,208 | B2 * | 7/2008 | Schmidt | H01R 13/6315 439/578 |
| 9,705,248 | B1 * | 7/2017 | Ko | H01R 13/6275 |
| 2003/0027435 | A1 | 2/2003 | Schneider | |
| 2004/0014350 | A1 | 1/2004 | McMullen | |
| 2009/0275226 | A1 | 11/2009 | Chen | |

* cited by examiner

ELECTRICAL CIRCULAR PLUG-IN CONNECTOR HAVING A PUSH-PULL LOCKING MECHANISM

TECHNICAL FIELD OF INVENTION

The invention relates to an electrical circular plug-in connector having a plug part and a counter-plug part, which can be releasably locked together, and respectively having at least one plug-in contact, and having a locking mechanism according to the push-pull principle on the plug side, which mechanism has at least one locking element that extends axially and can be deflected radially, which element is provided with a radially inwardly protruding detent arranged transversely thereto, to which an outwardly open latching trap is assigned on the counter-plug part side, whereby the locking element is capable of actuation by means of an axially displaceable unlocking sleeve supported by the plug part at least in such a way that the detent and the latching trap are capable of moving out of engagement in the course of the displacement of the unlocking sleeve against the direction of plugging-in of the plug part. The at least one locking element in this case is integrally molded on a retaining ring, which on the plug side is mounted on the plug part between the unlocking sleeve and a front hollow cylindrical plug region of a plug part housing of the plug part, whereby the detent has a rear sliding ramp arranged at the rear in the direction of plugging-in of the plug part, and the latching trap has an associated inner rear counter-sliding ramp arranged at the rear in the direction of plugging-in of the plug part, which pull the plug part and the counter-plug part together in a play-free manner by means of a spring force component acting inwardly in a radial direction.

DISCUSSION OF RELATED ART

The expression push-pull locking system is generally used to denote a locking system of a plug-in connector, in which the plug part is connected to the counter-plug part in a mechanically secure manner as the electrical contacts are plugged into engagement with one another, by pushing the plug part into the counter-plug part. After the plug part has been plugged completely into the counter-plug part, the plug part is locked automatically to the counter-plug part. Locking in this case takes place by means of a locking arrangement provided on the plug part and capable of detachable engagement in the counter-plug part, which locking arrangement, for example, has at least one locking element that is capable of being deflected in the radial direction and/or in the peripheral direction with a protruding detent, which engages for locking in an assigned latching trap or engages behind it. An unlocking sleeve that is guided in a displaceable manner on the plug part housing in the direction of plugging-in engages over the locking element with the plug-in connector locked and permits the locking element to snap out of engagement from the counter-plug part housing in the presence of a tensile force acting upon the plug part against the plugging-in direction. Unlocking of the plug part from the counter-plug part is only possible by causing the unlocking sleeve to be displaced against the direction of plugging-in of the plug part, and by causing the plug part to be displaced simultaneously away from the counter-plug part, until the detent and the latching trap move out of engagement. Reference is made to publication US 2004/0 014 350 A1, for example, with regard to the prior art.

US 2004/0 014 350 A1 discloses an electrical coaxial plug connector, which has plug part with a contact pin and a counter-plug part with a plug contact socket, which are capable of being locked together via a push-pull locking mechanism. The tubular plug part has a receiving section on the plug side, and the tubular counter-plug part has a feed-in section for the receiving section of the plug part. A circumferential locking groove is arranged at one end of the feed-in section of the counter-plug part facing away from the plug part. The receiving section of the plug part carries a push-pull locking mechanism, which interacts with the locking groove of the feed-in section of the counter-plug part in the locked state. The push-pull locking mechanism comprises a number of axially extending, radially deflectable locking elements each with a radially inwardly protruding detent arranged transversely thereto, which locking elements in each case engage in the locking groove of the counter-plug part with the coaxial plug connector plugged together. The locking elements are arranged on an annular body, which is immovably fixed on the receiving section of the plug part. In order to prevent the unintentional deflection of the locking elements, a securing sleeve that is displaceably mounted on the plug part is provided, which is capable of displacement from a securing position, in which it supports the locking elements radially from the outside, into a release position, in which it does not engage over the locking elements, and vice versa. The securing sleeve is not subjected to spring force and is moved back and forth manually between the securing position and the release position.

The fact that the axial locking is not play-free and the securing sleeve is not fixed in the securing position by spring force is considered to be a disadvantage in this previously disclosed prior art. This means that the plug part is readily capable of working loose from the counter-plug part of its own accord in the event of vibrations occurring. In addition, the locking is only conditionally play-free.

The invention accordingly has as its object to come up with a remedy here and to propose an improved electrical circular plug-in connector, in which the plug part is easily plugged onto the counter-plug part and pulled off therefrom, and in the state adopted by the counter-plug part, including under high vibrational loadings, is retained securely and in a completely play-free manner on the counter-plug part. The locking mechanism of the proposed electrical plug-in connector according to the push-pull principle is intended in addition to be comparatively uncomplicated and to be constructed with few component parts, which are easy to manufacture from a production engineering point of view, simple to install and cost-effective.

Said object is accomplished according to the invention by an electrical plug-in connector having the characterizing features of the patent described herein.

SUMMARY OF THE INVENTION

In the proposed electrical circular plug-in connector, the at least one locking element is molded on a retaining ring, which is mounted on the plug part on the plug side radially between the unlocking sleeve and a front hollow cylindrical plug region of the plug part. A plug-in region of the counter-plug part engages in the plug region when the plug part is plugged into the counter-plug part. The detent on the locking element has a rear sliding ramp arranged at the rear in the direction of plugging-in of the plug part, and the latching trap on the counter-plug part has an associated rear counter-sliding ramp arranged on the inside at the rear in the direction of plugging-in of the plug part, which sliding ramps pull the plug part and the counter-plug part together permanently and in a play-free manner by means of a spring force component acting inwards in the radial direction as the plug part is locked to the counter-plug part and in the locked state of the circular plug-in connector. The locking trap is a depression in the plug-in region of the counter-plug part with a front and rear flank in the plugging-in direction, which flanks extend respectively in an inclined manner. As a result, the locking element is capable of actuation by means of an axially displaceable locking sleeve supported by the plug part, at least in such a way that the detent and the latching trap, in conjunction with the movement of the unlocking sleeve, are able to make their way against the direction of plugging-in of the plug part from a securing position into a release position in which the locking elements can move out of engagement.

According to the invention, a securing sleeve for the at least one locking element that is capable of axial displacement with the unlocking sleeve is arranged between the retaining ring with the at least one molded locking element and the unlocking sleeve, which securing sleeve is acted on by spring force in the direction of plugging-in of the plug part by means of a helical pressure spring, which is supported at the rear on the plug part housing and inside at the rear on the unlocking sleeve of the plug part. The securing sleeve is connected directly or indirectly to the unlocking sleeve and engages, at least partially, over the retaining ring as well as the at least one locking element that is molded thereon. In the process, the securing sleeve acts upon the locking element with a force that is directed radially inwards, while a front sleeve section, which constitutes a pressure surface, of the securing sleeve acts upon the locking element, whereby, at least when the detent is in engagement with the latching trap, the front sleeve section of the securing sleeve is held in position permanently on the front free end of the locking element, on which the detent extends radially inwards. This is achieved by the helical pressure spring, which presses the unlocking sleeve and the securing sleeve in the direction of the plug region. The effect of the securing sleeve can be preset with a fixed value by means of the spring force of the pressure spring. In this case, the locking element is capable of actuation, at least in the radial direction of the plug part, towards the inside and/or towards the outside in such a way that the detent and the latching trap are able to move into and/or out of engagement.

The securing sleeve is displaced by means of the unlocking sleeve in and against the direction of plugging-in of the plug part. For this purpose, the securing sleeve can be fixed to the unlocking sleeve immovably or can be fixed to the unlocking sleeve movably in relation to the unlocking sleeve. The securing sleeve is intended, on the one hand, to ensure that at least one locking element of the locking mechanism on the plug part side is secured in such a way that the detent and the latching trap remain securely in engagement, and, on the other hand, to ensure that the locking is self-adjusting, i.e. that it displaces the locking element with the detent at least partially radially towards the inside when the securing sleeve is in contact with the front sleeve section on the actuating cam of the locking element. The securing sleeve thus acts, both during locking of the plug part to the counter-plug part and in the locked state of the circular plug-in connector, upon the at least one locking element with the detent formed thereon, and in so doing protects the locking element from undesired deflection, for example as a result of vibrations. In so doing, it secures the locking of the circular plug-in connector according to the invention and reliably prevents the undesired release of the plug part from the counter-plug part. In this case, the securing sleeve can be embodied so that it is closed in the form of a tube or is provided with longitudinal slots. If the securing sleeve is of segmented configuration, the segments formed by the longitudinal slots accordingly adjoin the axially extending locking elements and are assigned thereto.

Advantageously, the securing sleeve in the direction of plugging-in of the plug part has at the front a sleeve section that is inclined outwardly in a radial direction acting as a pressure surface, with which the securing sleeve applies pressure to the free end of the locking element and, in so doing, presses it in the direction of the latching trap.

In one embodiment of the invention, the securing sleeve is expediently molded on the unlocking sleeve. Two parts are thus combined into a single part, which has a favorable influence on the part costs and the assembly costs of the circular plug-in connector according to the invention and on the stability of these parts. In order to further simplify the assembly, the retaining ring is snapped into position with the at least one locking element and/or the securing sleeve preferably on the body of the plug part.

In a preferred embodiment of the circular plug-in connector according to the invention, the detent has a front sliding ramp arranged at the front in the direction of plugging-in of the plug part, and the latching trap has an associated outer rear counter-sliding ramp arranged at the rear in the direction of plugging-in of the plug part, which automatically deflect the locking element radially outwards for the purpose of locking. The outer rear counter-sliding ramp of the latching trap is formed by reducing the wall thickness of the plug-in region of the counter-plug part and leads to the inner rear counter-sliding ramp of the latching trap. As the plug part is plugged together with the counter-plug part, the front sliding ramp moves over the outer rear counter-glide ramp to the inner rear counter-glide ramp and into the depression of the latching trap, whereby the rear sliding ramp of the detent slides along the inner rear counter-sliding ramp in the depression.

In this case, the height of the detent is preferably the same as or smaller than the depth of the latching traps, so that the front or rear slide ramps and counter-sliding ramps of the at least one detent of the plug part and of the at least one latching trap of the counter-plug part that are assigned to one another are able to slide on one another unimpaired, until completely play-free locking is achieved. Locking of the circular plug-in connector by means of a number of locking elements with a detent and with a corresponding number of latching traps has been found to be particularly favorable, in particular when the locking elements are arranged distributed as uniformly as possible in the peripheral direction of the circular plug-in connector. The latching traps in this case can be configured as individual depressions or can be combined together to produce a peripheral groove. The elastically configured locking elements that are capable of deflecting radially outwards are, on the one hand, self-resetting and are subjected in addition, on displacement of the unlocking sleeve into the securing position, i.e. in the direction of inserting the plug part into the counter-plug part, in the radial direction inwards to a pressure force, which leads to the detents being pushed as far as possible into the latching traps, whereby the rear sliding ramps of the detents are maintained in contact on the rear inner counter-sliding ramps of the latching traps. This causes the plug part to move in the direction of the counter-plug part until they are connected to one another in a play-free manner.

The pressure on the locking elements is also maintained by the unlocking sleeve in the securing position of the unlocking sleeve, so that, even under high vibrational loadings, no free play arises between the plug part and the counter-plug part.

In an advantageous embodiment of the invention, the locking element has an actuating cam between the detent and the retaining ring, which actuating cam extends radially outwards in the direction of the unlocking sleeve and upon which the securing sleeve acts. The actuating cam is embodied with a sliding flank inclined on the rear side in the direction of plugging-in of the plug part, which sliding flank acts upon the securing sleeve with an axial force component and with a radial force component.

If the unlocking sleeve is not displaced against the direction of plugging-in of the plug part, the front sleeve section of the securing sleeve that is inclined outwards in a radial direction slides along the sliding flank of the actuating cam and, in so doing, causes the locking element to move radially towards the inside. If the unlocking sleeve is displaced against the direction of plugging-in of the plug part, this also acts upon the securing sleeve and causes the latter to move directly or indirectly against the direction of plugging-in of the plug part. In this case, the securing sleeve moves away from the actuating cam, so that the detent is capable of free displacement radially and is able to move out of engagement with the latching trap. In this case locking element, depending on its design, swivel to the outside either independently or by means of an introduced radial force component. The force component can be caused to move in the axial direction away from the counter-plug part by the movement of the unlocking sleeve against the plug part housing or by pulling on the plug part housing.

In one embodiment of the circular plug-in connector according to the invention, the at least one locking element of the retaining ring is of self-locking configuration, such that the detent snaps automatically into engagement in the latching trap and is capable of being secured there by means of the securing sleeve when the detent engages at least partially over the latching trap. In another embodiment of the invention, on the other hand, the at least one locking element of the retaining ring is of self-unlocking configuration, such that the detent is capable of snapping into engagement in the latching trap by means of the securing sleeve and is capable of being secured there when the detent engages at least partially over the latching trap, and snaps automatically out of engagement from the latching trap when the securing sleeve is not acting upon the locking element.

The retaining ring with the at least one molded locking element in this case can be an injection-molded component made from a thermoplastic plastic material or a component produced by stamping and bending made from an elastically deformable metal material. The retaining ring with the integrally configured self-unlocking locking element is preferably made of metal or a metal alloy, and the retaining ring with the integrally configured self-locking locking element is preferably molded from a plastic or from a plastic mixture.

Advantageously, the unlocking hook of the locking element that swivels radially outwards causes the securing sleeve to move against the direction of plugging-in of the plug part when the unlocking sleeve is displaced against the direction of plugging-in of the plug part. The securing sleeve thereby releases the at least one locking element of the plug part, so that the locking element is capable of being deflected radially outwards, in order to permit unlocking of the plug part from the counter-plug part.

In a preferred embodiment of the invention, in which the locking element is self-locking, the at least one locking element has externally an unlocking hook that is arranged on the actuation cam and is open in the direction of the counter-plug part, and the unlocking sleeve has internally an associated carrier hook for the unlocking hook that is open in the opposite direction. In conjunction with the displacement of the unlocking sleeve against the direction of plugging-in of the plug part into the release position, the carrier hook for the unlocking sleeve takes hold of the unlocking hook of the locking element and continues to deflect it, in each case with increasing displacement of the unlocking sleeve, further radially outwards into the release position, until the at least one detent and the at least one latching trap are out of engagement. In the process, the rear sliding ramp of the detent slides along the rear inner counter-sliding ramp of the latching trap.

In order to facilitate simple unlocking without the application of too much force, and in order to protect the unlocking hook or the associated carrier hook from damage, the unlocking hook and the carrier hook are appropriately suitably embodied in respect of their form. The unlocking hook that is molded on the locking element preferably has an unlocking sliding surface that is inclined towards the counter-plug part, and the carrier hook that is molded on the unlocking sleeve has an associated unlocking counter-sliding surface that is inclined away from the counter-plug part, which interact in such a way that, in conjunction with the movement of the unlocking sleeve against the direction of plugging-in of the plug part, the carrier hook of the unlocking sleeve causes the locking element to be deflected continuously radially outwards. In the reversed direction of movement of the unlocking sleeve into the securing position, the locking element moves radially inwards until the carrier hook of the unlocking sleeve is released from the unlocking hook of the locking element, such that the detent of the locking element of the plug part and the associated latching trap of the counter-plug part, as described above, fix the plug part and the counter-plug part to one another in a play-free manner. For as long as the unlocking hook and the carrier hook are in engagement with one another, the unlocking sliding surface of the unlocking hook of the locking element that is inclined towards the counter-plug part and the unlocking counter-sliding surface of the carrier hook of the unlocking sleeve that is inclined in the opposite direction are in engagement with one another and, in the event of the deflection of the locking element, slide radially inwards or outwards along one another.

The securing sleeve is preferably in contact with the unlocking hook of the locking element at the actuating cam on the side facing away from the counter-plug part. The corresponding contact surface in this case is provided as an inclined rear sliding flank of the unlocking hook. The inclined sliding flank permits the simple swiveling of the unlocking element radially inwards when the securing sleeve is moved in the direction of the counter-plug part.

The locking or unlocking of the plug part to or from the counter-plug part is effected in all embodiments of the electrical circular plug-in connector according to the invention with at least one self-locking locking element, as follows:

As the plug part and the counter-plug part are moved together axially, the unlocking sleeve is displaced in the direction of the counter-plug part, whereby the latching trap approaches the detent. In the process, the front sliding ramp of the detent first slides along the rear outer counter-sliding ramp of the latching trap. At the same time, the carrier hook of the unlocking sleeve is distanced increasingly from the unlocking hook of the locking element and, in so doing, releases the locking element. As soon as the front sliding ramp of the at least one detent has overcome the associated rear outer counter-sliding ramp of the associated latching trap, the unlocking hook of the locking element no longer engages in the carrier hook of the unlocking sleeve, so that the at least one released diverted elastically configured locking element, because of the inherent restoring spring force and because of the force exerted by the securing sleeve, is displaced radially inwards until the detent of the locking element engages in a play-free manner in the latching trap of the counter-plug part. In the process, the rear sliding ramp of the detent slides along the rear inner counter-sliding ramp of the latching trap and is supported there in the axial direction. These remain in contact with one another and pull the plug part in a play-free manner against the counter-plug part.

The unlocking sleeve is in the securing position in the locked state of the circular plug-in connector. In this case, the securing sleeve acts in the locking position of the unlocking sleeve upon the at least one locking element in an uninterrupted manner via the wedge-shaped sleeve section, so that a vibration-resistant and permanently play-free connection of the plug part to the counter-plug part is assured.

Unlocking of the plug part from the counter-plug part appropriately takes place in the reverse order. For this purpose, the unlocking sleeve is moved from the securing position in the direction of the release position, so that the carrier hook of the unlocking sleeve engages in the unlocking hook of the locking element and pulls this radially outwards. In the process, the securing sleeve is displaced against the direction of plugging-in of the plug part by means of the unlocking hook over the rear sliding flank of the unlocking hook, which acts upon the wedge-shaped sleeve section of the securing sleeve. The unlocking sleeve can be moved against the direction of plugging-in of the plug part only until the carrier hook of the unlocking sleeve engages completely in the unlocking hook of the locking element. In this case, the locking element is swiveled outwards over the inclined unlocking counter-sliding surface of the carrier hook of the unlocking sleeve, which interacts with the correspondingly inclined unlocking sliding surfaces of the unlocking hook of the locking element, until the detent of the locking element and the latching trap of the counter-plug part are out of engagement. The plug part is now able to be pulled apart axially from the counter-plug part. In the course of pulling apart, the rear sliding ramp of the detent slides along the rear inner counter-sliding ramp and overcomes it. If the plug part is moved further away from the counter-plug part, the front sliding ramp of the detent slides along the rear outer counter-sliding ramp of the latching trap, whereby the spring force that acts upon the securing sleeve is increased. As soon as the unlocking sleeve has been released, the securing sleeve causes the unlocking sleeve on the plug part housing to move in the direction of plugging-in of the plug part, so that the carrier hook of the unlocking sleeve is released from the unlocking hook of the locking element, and the locking element is capable of free radial displacement.

In another preferred embodiment of the invention, in which the locking element is self-unlocking, the at least one locking element has no unlocking hook arranged externally on the actuating cam, and the unlocking sleeve internally has no associated carrier hook for the unlocking hook that is open in the opposite direction. After plugging-in the plug part into the counter-plug part, locking of the circular plug-in connector is effected by the securing sleeve that is connected to the unlocking sleeve, in that said securing sleeve acts upon the actuating cam of the at least one locking element by means of the sleeve section that is inclined outwards in the radial direction with a force component that is directed radially inwards, which is determined by the spring force exerted by the helical pressure spring. The spring force of the pressure spring in this case must be selected so that the inwardly directed force component for each of the provided locking elements, which acts upon the respective actuation cams, is the same or greater than a restoring force of the at least one locking element.

As the unlocking sleeve is displaced against the direction of plugging-in of the plug part into the release position, the securing sleeve releases the locking element by moving away from the actuating cam, so that the locking element with the detent arranged at the free end of the locking element swivels of its own accord, with the increasing displacement of the unlocking sleeve, continuously further outwards radially into the release position, until the at least one detent and the at least one latching trap are out of engagement. In the process, the rear sliding ramp of the detent slides along the rear inner counter-sliding ramp of the latching trap.

When the detent is in engagement with the latching trap, locking and unlocking take place with regard to the movement of the detent in relation to the latching trap in a similar manner to that involved in the previously described self-locking latching element. When locking the circular plug-in connector, the securing sleeve is in contact with the actuating cam of the locking element on the side facing away from the counter-plug part, and in particular on its rear sliding flank. The inclined sliding flank permits the simple swiveling of the unlocking element radially inwards when the securing sleeve is moved in the direction of the counter-plug part.

Locking or unlocking of the plug part with or from the counter-plug part is effected in all embodiments of the electrical circular plug-in connector according to the invention with at least one self-locking locking element, as follows:

After the plug part and the counter-plug part have been moved together axially, the securing sleeve is displaced with the unlocking sleeve in the direction of the counter-plug part, whereby the latching trap approaches the detent. In the process, the front sliding ramp of the detent first slides along the rear outer counter-sliding ramp of the latching trap. At the same time, the carrier hook of the unlocking sleeve is distanced increasingly from the actuating cam. As soon as the front sliding ramp of the at least one detent has overcome the associated rear outer counter-sliding ramp of the associated latching trap, the detent of the locking element is forced by the force component that is introduced via the front sleeve section of the securing sleeve to slide into the latching trap, as a consequence of the elastically configured locking element being caused to move radially inwards with its free end until the detent of the locking element engages in a play-free manner in the latching trap of the counter-plug part. In the process, the rear sliding ramp of the detent slides along the rear inner counter-sliding ramp of the latching trap and is supported there in the axial direction. These remain in contact with one another and pull the plug part against the counter-plug part in a play-free manner.

In the course of the displacement of the unlocking sleeve against the direction of plugging-in of the plug part, the outwardly swiveling locking element, in the case in which the securing sleeve is not molded on the unlocking sleeve, causes the securing sleeve to move over the actuating cam against the direction of plugging-in of the plug part. The spring force, which acts upon the unlocking sleeve and/or the securing sleeve in the direction of plugging-in of the plug part, is selected so that it is greater than the radial spring force of the at least one locking element that is molded on the retaining ring, so that the locking is secure and also self-adjusting.

In the locked state of the circular plug-in connector, the unlocking sleeve is present in the securing position. In this case, the securing sleeve acts in the locking position of the unlocking sleeve, preferably via the wedge-shaped sleeve section, upon the at least one locking element in an uninterrupted manner, so that a vibration-resistant and permanently play-free connection of the plug part to the counter-plug part is assured.

Unlocking of the plug part from the counter-plug part appropriately takes place in the reverse order. For this purpose, the unlocking sleeve is moved from the securing position in the direction of the release position, whereby the securing sleeve moves axially away from the actuating cam of the locking element, so that the latter, because of its inherent restoring spring force, swivels outwards of its own accord and, in so doing, snaps the detent out of engagement with the latching trap.

BRIEF DESCRIPTION OF THE DRAWINGS

The invention is described in more detail below on the basis of two illustrative embodiments that are represented in the drawing. Further characterizing features of the invention can be appreciated from the following description of the illustrative embodiments of the invention in conjunction with the claims and the accompanying drawing. The individual characterizing features of the invention can be implemented on their own or for multiple in the event of different embodiments of the invention. In the drawing:

DETAILED DESCRIPTION OF THE INVENTION

Figure 1A:
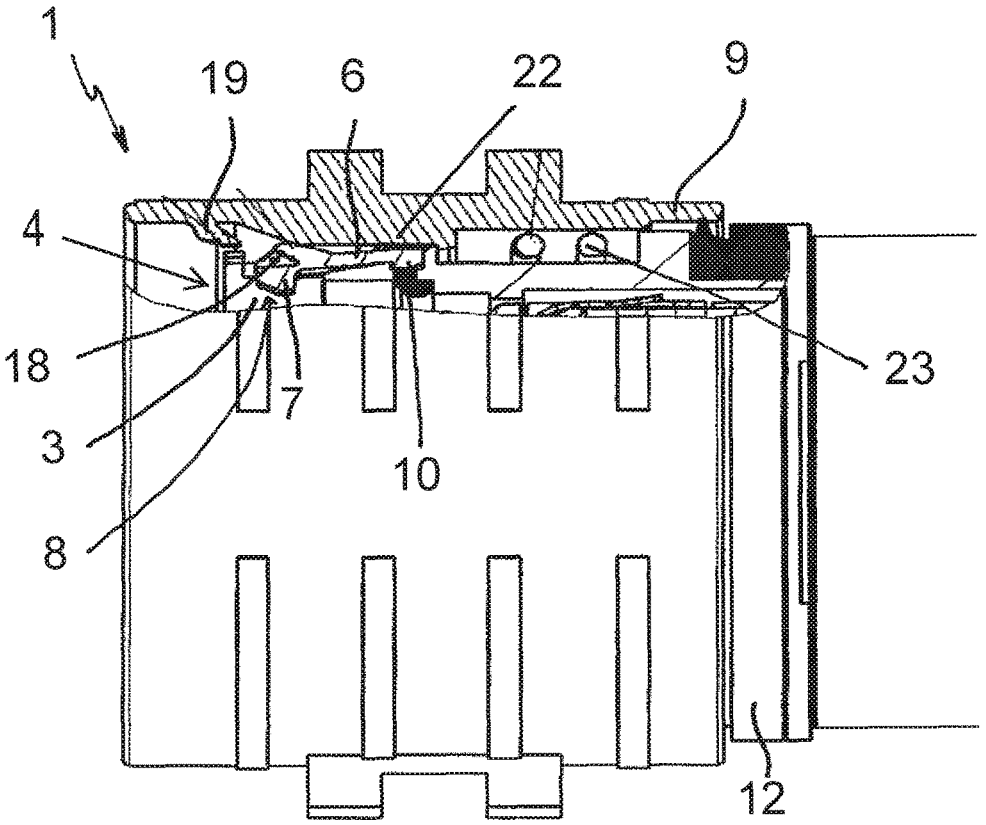
FIG. 1A depicts a first illustrative embodiment of a plug part of a circular plug-in connector according to the invention, in which the locking element is of self-locking configuration, in a longitudinal representation.
Figure 1B:
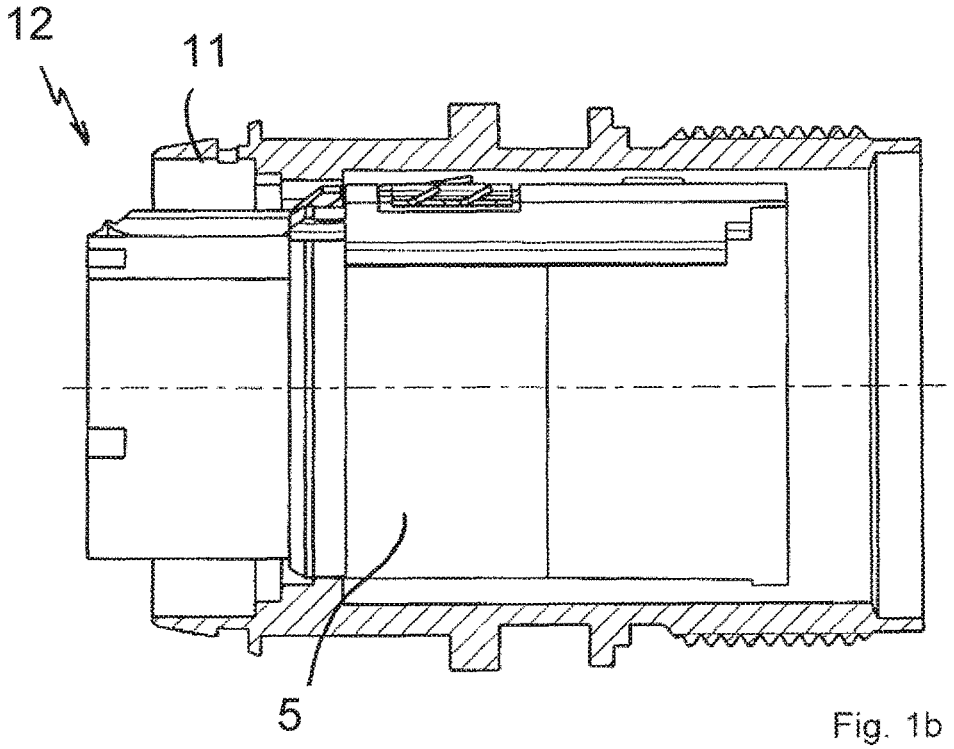
FIG. 1B schematically depicts a plug part housing and an insulating contact holder of the embodiment of FIG. 1A.
Figure 1C:
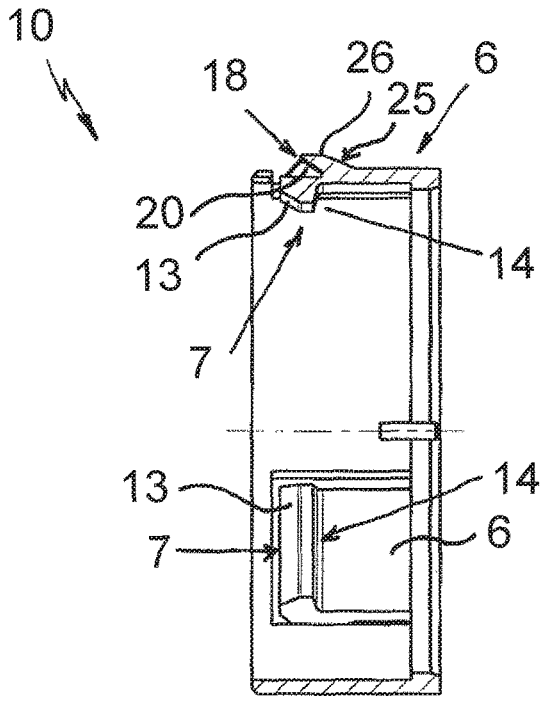
FIG. 1C depicts a retaining ring of the embodiment of FIG. 1A.
Figure 1D:
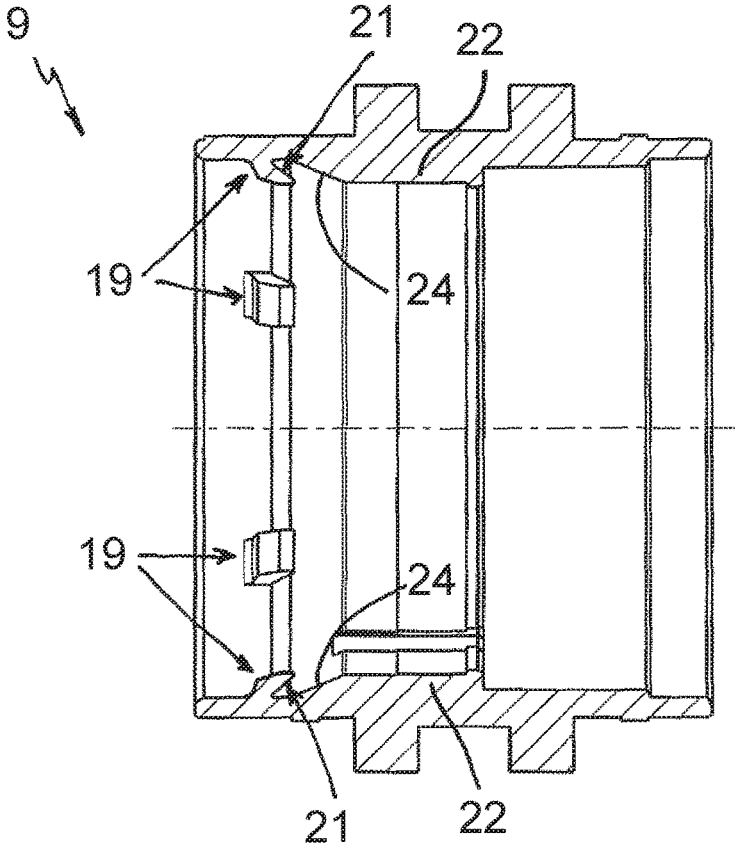
FIG. 1D depicts an unlocking sleeve of the embodiment of FIG. 1A.
Figure 2:
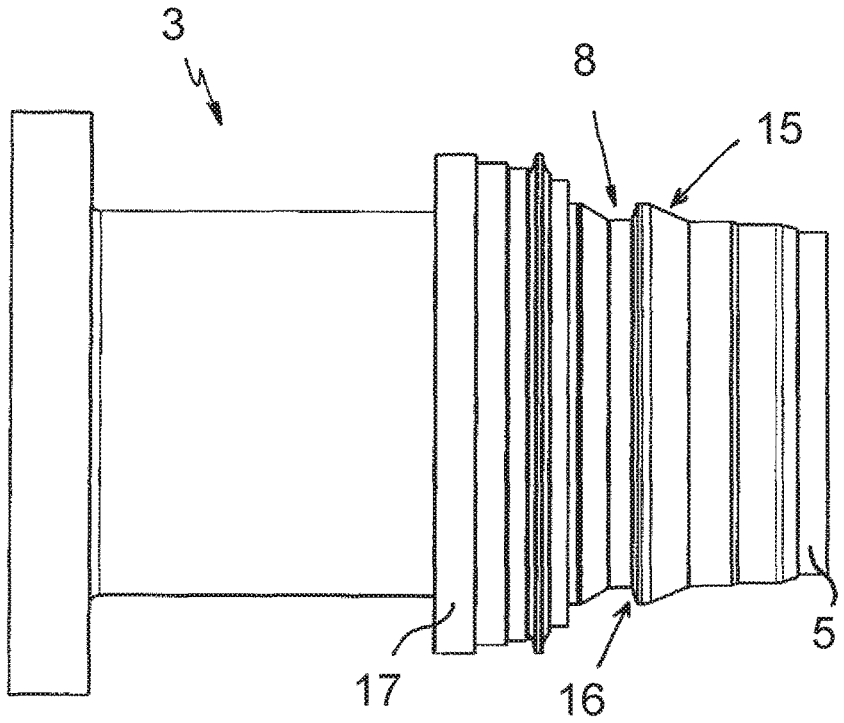
FIG. 2 depicts the counter-plug part of a circular plug-in connector according to the invention assigned to the plug part according to FIG. 1A, in a longitudinal representation.

FIGS. 1A depicts, as a first illustrative embodiment, a plug part 1 of an electrical circular plug-in connector 2 according to the invention, to which the counter-plug part 3 represented in FIG. 2 is assigned. The plug part 1 and the counter-plug part 3 are releasably lockable to one another and in each case have at least one electrical plug contact, which is received in an insulating contact holder 4 of the plug part 1 or in an insulating contact holder 5 of the counter-plug part 3. The plug contacts of the plug part 1 and of the counter-plug part 3, which are not represented in FIGS. 1A and 1C to 4, are implemented as pin contacts and socket contacts that are complementary to one another. The plug part 1 has a locking mechanism according to the push-pull principle, which comprise in the illustrative embodiment a number of axially extending, radially deflectable locking elements 6, which are configured in a self-locking manner and in each case with a radially inwardly protruding detent 7 arranged transversely thereto, to which an outwardly open latching trap 8 represented in FIG. 2 is assigned on the side of the counter-plug part. The locking elements 6 are arranged in relation to the latching traps 8 in such a way that the detents 7 engage in the latching traps 8 without the application of external force. The locking elements 6 of the plug part 1 are capable of actuation by means of an axially displaceable unlocking sleeve 9 (shown in FIG. 1D) that is supported by the plug part 1, in such a way that the detents 7 of the plug part 1 and the latching traps 8 of the counter-plug part 3 move out of engagement in conjunction with the movement of the unlocking sleeve 9 against the direction of plugging-in of the plug part 1.

The locking elements 6 of the plug part 1, of which only one is represented or is visible in FIG. 1A, are molded on a retaining ring 10 (shown in FIG. 1C), which is mounted on the plug side on the plug part 1 between the unlocking sleeve 9 and a front hollow cylindrical plug region 11 of a plug part housing 12 (shown in FIG. 1B) of the plug part 1. The detent 7 has a rear sliding ramp 14 arranged at the rear in the direction of plugging-in of the plug part 1, and the latching trap 8 has an assigned rear counter-sliding ramp 16 arranged inside at the front in the direction of plugging-in of the plug part 1, which pull the plug part 1 and the counter-plug part 3 together in a play-free manner in the course of locking by means of a spring force component acting inwards in the radial direction. The detent 7 also has a front sliding ramp 13 arranged at the front in the direction of plugging-in of the plug part 1, and the latching trap 8 has an assigned rear sliding ramp 15 arranged outside at the rear in the direction of plugging-in of the plug part 1, which deflect the locking element 6 radially outwards for the purpose of locking it. The corresponding counter-sliding ramps 15, 16 are represented in FIG. 2. According to FIG. 2, the latching traps 8, of which only one is represented or visible, are configured as recesses. The front sliding ramp 13 of the detent 7 interacts with the outer rear counter-sliding ramp 15 of the latching trap 8, and the rear sliding ramp 14 of the detent 7 interacts with the inner rear counter-sliding ramp 16 of the latching trap 8 in the course of locking or in the locked state, and accordingly vice versa in the course of unlocking. The mode of operation can be appreciated from FIGS. 3 and 4 and is described below in more detail in conjunction with these figures.

The locking elements 6 each have externally an actuating cam 26 with an unlocking hook 18 that is open in the direction of the counter-plug part 3. The unlocking sleeve 9 has internally a carrier hook 19 for the unlocking hooks 18 corresponding to the number of locking elements 6, assigned to the unlocking hooks 18 of the locking elements 6, that are open in the opposite direction. In conjunction with unlocking the plug part 1 from the counter-plug part 3 by a movement of the unlocking sleeve 9 against the direction of plugging-in of the plug part 1, the carrier hooks 19 of the unlocking sleeve 9 engage in the unlocking hooks 18 of the locking elements 6 and cause these to deflect radially outwards, so that the detents 7 of the locking elements 6 and the latching traps 8 of the counter-plug part housing 17 come out of engagement. The mode of operation is likewise explained in more detail in the description in FIGS. 3 and 4.

The unlocking hooks 18 of the actuating cams 26 of the locking elements 6 have an unlocking sliding surface 20 inclined towards the counter-plug part 3, and the carrier hooks 19 have an assigned unlocking counter-sliding surface 21 inclined away from the counter-plug part 3, which are embodied and arranged in such a way, and which interact in such a way that, in conjunction with the movement of the unlocking sleeve 9 against the direction of plugging-in of the plug part 1, the carrier hooks 19 of the unlocking sleeve 9 cause the locking elements 6 to deflect radially outwards.

The retaining ring 10, on which the locking elements 6 are arranged protruding axially in the direction of plugging-in, is made from a plastic material in the represented illustrative embodiment, whereby the locking elements 6 are elastically configured. The retaining ring 10 is arranged on the hollow cylindrical plug region 11 of the plug part housing 12 and is locked thereto, whereby an axially displaceable securing sleeve 22 for the locking elements 6 is arranged between the retaining ring 10 with the molded locking elements 6 and the unlocking sleeve 9. The securing sleeve 22 in the represented illustrative embodiment is molded internally on the unlocking sleeve 9. It can also be configured as a separate component. The securing sleeve 22 is acted upon in the direction of plugging-in of the plug part 1. For this purpose, the plug part 1 has a helical pressure spring 23, which is pretensioned and is supported axially on the plug part housing 12 and the securing sleeve 22.

The securing sleeve 22 appropriately has at the front in the direction of plugging-in of the plug part 1 a wedge-shaped sleeve section 24, which is in engagement with unlocking hooks 18 on an inclined rear sliding flank 25 of the actuating cam 26. The wedge-shaped sleeve section 24 force applies the locking elements 6 radially inwards and at the same time secures these against their unintentional deflection radially outwards. In the case of the movement of the unlocking sleeve 9 against the direction of plugging-in of the plug part 1, the unlocking hooks 18 which swivel radially outwards with the locking elements 6 cause the securing sleeve 2 to move against the direction of plugging-in of the plug part 1, by the sliding flank 25 being pressed against the wedge-shaped sleeve section 24 of the securing sleeve 22. Moreover, the securing sleeve 22 is also caused to move in addition directly through the unlocking sleeve 9.

Figure 3:
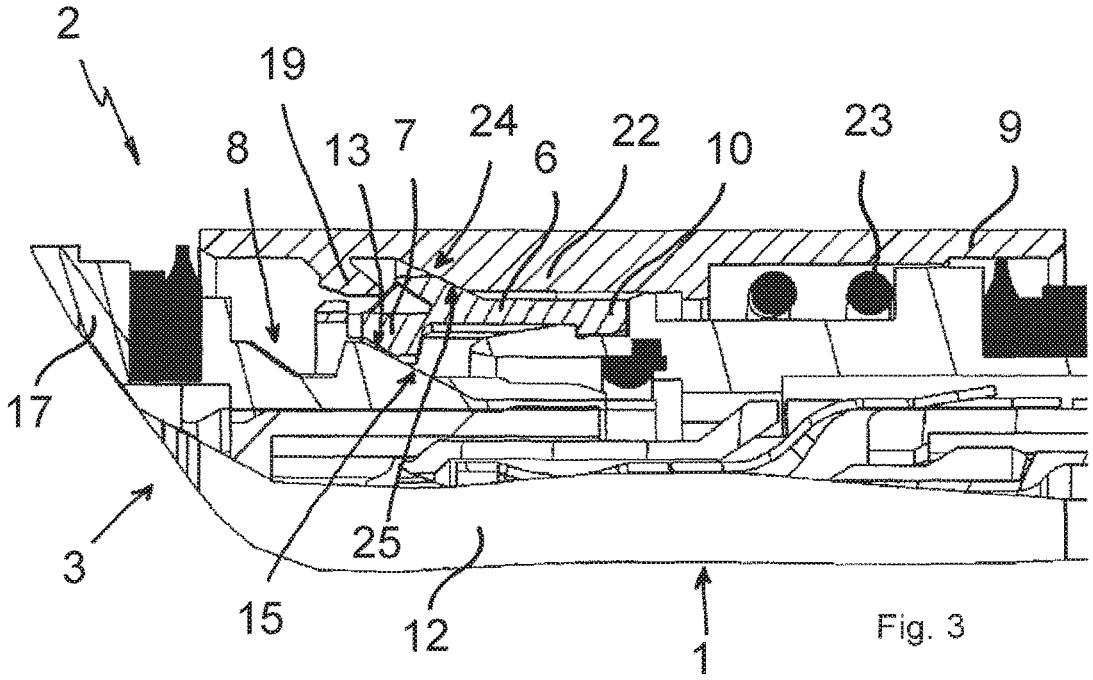
FIG. 3 depicts the plug part according to FIG. 1A and the counter-plug part according to FIG. 2 in the assembled, unlocked state.
Figure 4:
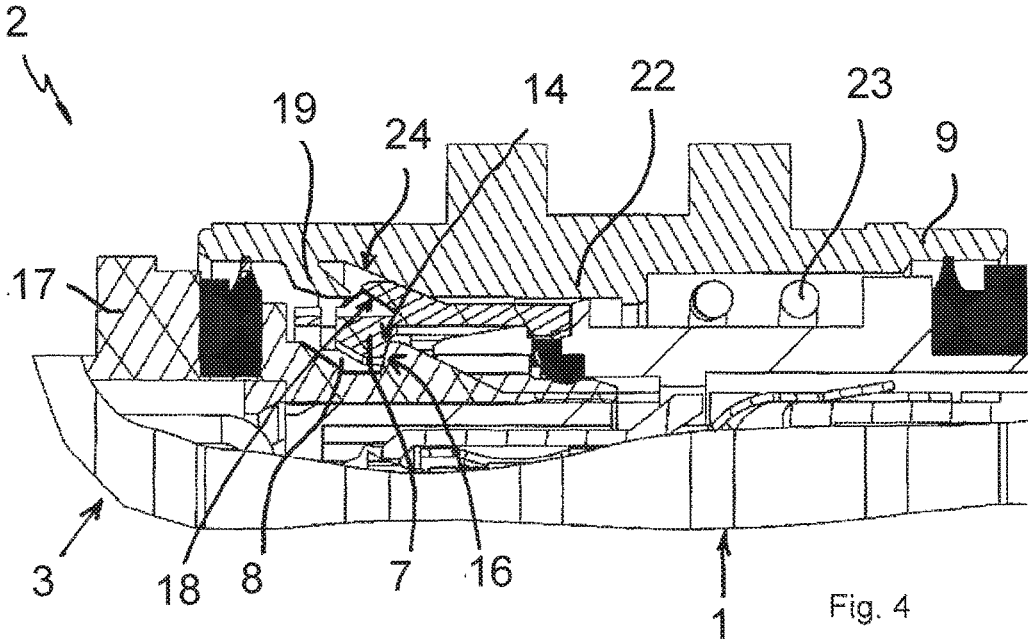
FIG. 4 depicts the plug part according to FIG. 1A and the counter-plug part according to FIG. 2 in the assembled, locked state.

The locking process and the unlocking process of the plug part 1 and the counter-plug part 3 of the circular plug-in connector 2 according to the invention will become apparent from FIGS. 3 and 4. In FIG. 3, the plug part 1 is inserted into the counter-plug part 3, although it is not yet locked thereto. The unlocking sleeve 9 in this case is in the release position. FIG. 4 illustrates the locked state of the circular plug-in connector 2, in which the unlocking sleeve 9 is in the locking position. During locking or unlocking, the locking sleeve 9 is in an intermediate position between the release position and the locking position and interacts with the locking elements 6.

In FIG. 3, the unlocking sleeve 9 is in the release position and is pulled back in relation to the counter-plug part 3 against the direction of plugging-in of the plug part 1. The plug part 1 and the counter-plug part 3 are not yet fully pushed into one another. The detents 7 of the locking elements 6 are not in engagement with the latching traps 8 of the counter-plug part housing 17. The front sliding ramps 13 of the detents 7 of the locking elements 6 of the plug part housing 12 are in contact with the rear counter-sliding ramps 15 of the latching traps 8 of the counter-plug part housing 17, which lead to the latching traps 8. The securing sleeve 22 is in contact with unlocking hooks 18 of the locking elements 6 of the plug part 1 with its wedge-shaped sleeve section 24 on the rear sliding flanks 25 of the actuating cams 26. The carrier hooks 19 of the unlocking sleeve 9 in this case are not visibly in engagement in this figure with the unlocking hooks 18 of the locking elements 6, whereby the securing sleeve 22 is acted upon by spring force in the direction of the counter-plug part 3 via the aforementioned helical pressure spring 23. The securing sleeve 22 also acts accordingly upon the unlocking sleeve 9.

As the plug part 1 and the counter-plug part 3 continue to be brought together axially, the unlocking sleeve 9 moves in the direction of the counter-plug part 3, whereby the latching traps 8 and the detents 7 move closer to one another. At the same time, the carrier hooks 19 of the unlocking sleeve 9 continue to move away from the unlocking hooks 18 of the locking elements 6 and release the locking elements 6. As soon as the front sliding ramps 13 of the detents 7 have overcome the assigned rear outer counter-sliding tamps 15 of the latching traps 8, the unlocking hooks 18 of the locking elements 6, as depicted in FIG. 4, no longer engage in the carrier hooks 19 of the unlocking sleeve 9, so that the released, diverted, elastically configured locking elements 6 is moved radially inwards by their inherent restoring spring force and by the spring force of the helical pressure soring 23 acting upon the securing sleeve 22 until the detents 7 of the locking elements 6 engage in the latching traps 8 of the counter-plug part housing 17 of the counter-plug part 3.

FIG. 4 illustrates the play-free, locked state of the circular plug-in connector 2, in which the unlocking sleeve 9 is in the securing position. As the detents 7 are snapped into engagement in the latching traps 8, the rear sliding ramps 14 of the detents 7 slide along the rear inner counter-sliding ramps 16 of the latching traps 8. These remain in contact with one another and pull the plug part 1 against the counter-plug part 3 in a play-free manner, as represented in FIG. 4. In the process, the securing sleeve 22, in the locking position of the unlocking sleeve 9, acts permanently on the locking elements 6 via the sleeve section 24 that is inclined outwards in the radial direction, so that a vibration-resistant and permanently play-free connection of the plug part 1 with the counter-plug part 3 is assured.

Unlocking of the plug part 1 from the counter-plug part 3 appropriately takes place in the reverse order. The unlocking sleeve 9 is displaced in the direction of the release position for this purpose, so that the carrier hooks 19 of the unlocking sleeve 9 engage in the unlocking hooks 18 of the locking elements 6 and pull them radially outwards. In the process, the securing sleeve 22 is displaced against the direction of plugging-in of the plug part 1 by means of the unlocking hooks 18 over the rear sliding flanks 25 of the actuating cams 26, which act upon the wedge-shaped sleeve section 24 of the securing sleeve 22. The unlocking sleeve 9 can be displaced against the direction of plugging-in of the plug part 1 only until the carrier hooks 19 of the unlocking sleeve 9 engage completely in the unlocking hooks 18 of the locking elements 6. In the process, the locking elements 6 are swiveled outwards over the inclined unlocking counter-sliding faces 21 of the carrier hooks 19 of the unlocking sleeve 9, which interact with the correspondingly inclined unlocking sliding surfaces 21 of the unlocking hooks 18 of the locking elements 6, to such an extent that the detents 7 of the locking elements 6 and the latching traps 8 of the counter-plug part housing 17 are out of engagement. The plug part 1 is now able to be pulled away axially completely from the counter-plug part 3.

Figure 5:
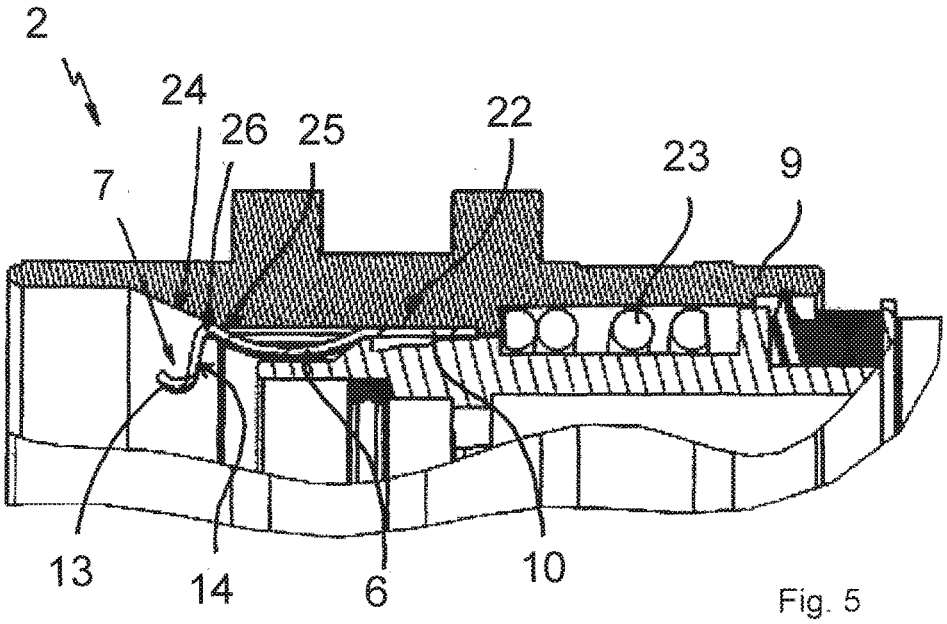
FIG. 5 depicts a second illustrative embodiment of a plug part of a circular plug-in connector according to the invention, in which the locking element is of self-unlocking configuration, in a longitudinal representation.

FIG. 5 depicts, as a second illustrative embodiment, a plug part 1 of an electrical circular plug-in connector 2 according to the invention, to which the counter-plug part 3 represented in FIG. 2 is assigned. In this case, the same reference designations as in the first illustrative embodiment are used for the following description. The counter-plug part 3 of the second illustrative embodiment conforms completely to that of the first illustrative embodiment. The plug part 1 of the second illustrative embodiment differs from that of the first illustrative embodiment in respect of the retaining ring 10 that is used with the molded locking elements 6 and its mode of operation. Only the differences between the two variants of the plug parts 1 are described below.

The plug part 1 and the counter-plug part 3 are capable of being locked detachably to one another according to the push-pull principle by means of the locking elements 6. The plug part 1 has a locking mechanism according to the push-pull principle, which comprise in the illustrative embodiment a number of axially extending, radially swiveling locking elements 6, which are embodied in a self-unlocking manner, and each of which has a radially inwards protruding detent 7 arranged transversely thereto, to which a latching trap 8 that is open to the outside is assigned on the counter-plug side as represented in FIG. 2. The locking elements 6 are arranged opposite the latching traps 8 in such a way that the detents 7 do not engage in the latching traps 8 without the application of external force. The locking elements 6 of the plug part 1 are capable of actuation by means of the axially displaceable unlocking sleeve 9 that is supported by the plug part 1, via the securing sleeve 22 that is connected mechanically to the unlocking sleeve 9, in such a way, via the sleeve section that is inclined outwards in the radial direction, that the detents 7 of the plug part 1 and the latching traps 8 of the counter-plug part 3 enter into engagement in conjunction with the movement of the unlocking sleeve 9 in the direction of plugging-in of the plug part 1.

The locking elements 6 of the plug part 1, of which only one is represented or visible in FIG. 5, are molded on a retaining ring 10, which is supported on the plug side on the plug part 1 between the unlocking sleeve 9 and a front hollow cylindrical plug region 11 of a plug part housing 12 of the plug part 1. The detent 7 has a rear sliding ramp 14 arranged at the rear in the direction of plugging-in of the plug part 1, and the latching trap 8 has an assigned rear counter-sliding ramp 16 arranged inside at the front in the direction of plugging-in of the plug part 1, which pull the plug part 1 and the counter-plug part 3 together in a play-free manner in the course of locking by means of a spring force component acting inwards in the radial direction.

Figure 6:
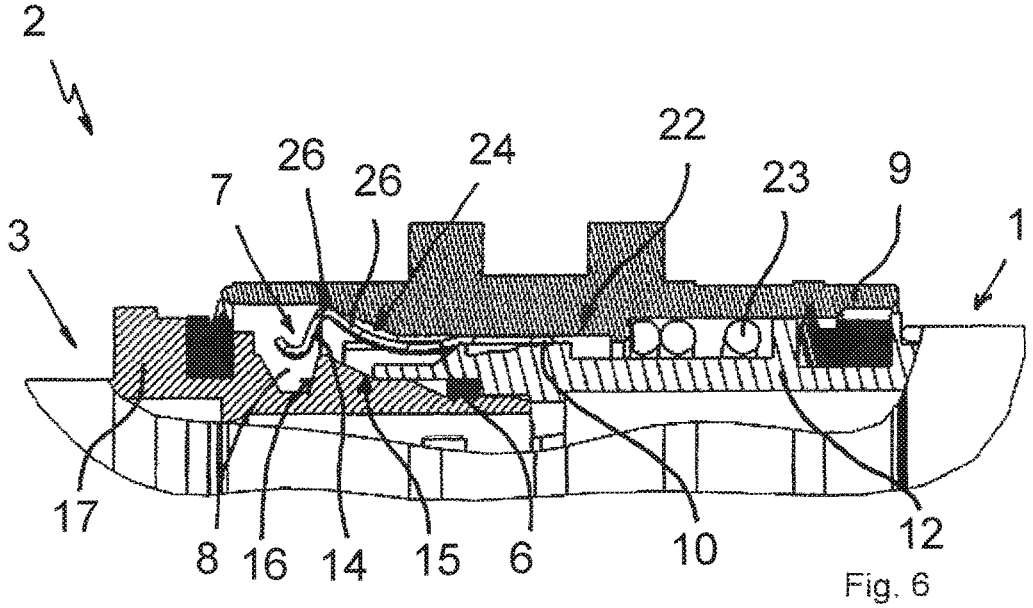
FIG. 6 depicts the plug part according to FIG. 5 and the counter-plug part according to FIG. 2 in the assembled, unlocked state.
Figure 7:
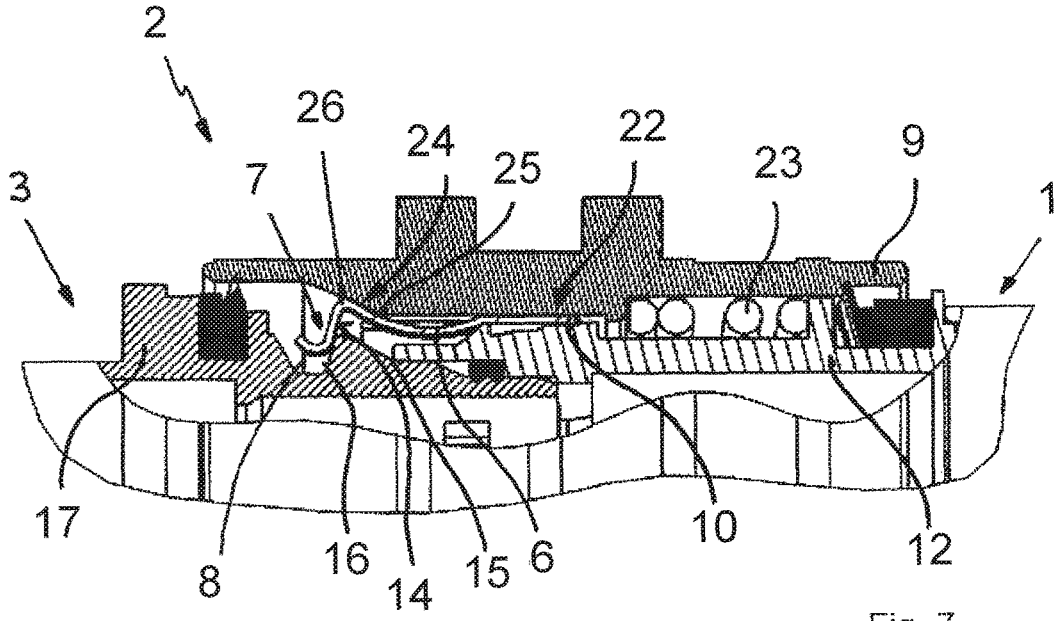
FIG. 7 depicts the plug part according to FIG. 1A and the counter-plug part according to FIG. 2 in the assembled, unlocked state.

The detent 7 in addition has a front sliding ramp 13 arranged at the front in the direction of plugging-in of the plug part 1, and the latching trap 8 has an assigned rear sliding ramp 15 arranged outside at the rear in the direction of plugging-in of the plug part, which cause the locking element 6 to be deflected outwards for the purpose of locking. The corresponding counter-sliding ramps 15, 16 are represented in FIG. 2. The mode of operation can be appreciated from FIGS. 6 and 7 and is described below in more detail in conjunction with the figures.

The locking elements 6 each have on the outside an actuating cam 26, which is configured without an unlocking hook 18. An unlocking hook is not required in this case, since the locking elements 6 are of self-locking configuration. As a result, the unlocking sleeve 9 in this illustrative embodiment also has no carrier hooks 19 internally for the missing unlocking hooks 18. The detent 7 is capable of being snapped into engagement in the latching trap 8 by means of the securing sleeve 22 and is capable of being secured there when the detent 7 engages at least partially over the latching trap 8 and snaps automatically out of the latching trap 8 as soon as the securing sleeve 22, with the sleeve section 24 inclined outwards in the radial direction, no longer acts upon the locking element 6 on the actuating cam 26. The spring force, which acts upon the securing sleeve 22 in the direction of plugging-in of the plug part 1, is greater than the radial spring force of the locking elements 6 that are molded on the retaining ring 10. It is in particular dimensioned with a significantly higher value. In the case of the manual displacement of the unlocking sleeve 9 against the direction of plugging-in of the plug part 1 for the purpose of unlocking the circular plug-in connector 23, the outwardly swiveling locking element 6 causes the securing sleeve 22 to move over the actuating cam 26 against the direction of plugging-in of the plug part 1.

The retaining ring 10, on which the locking elements 6 are arranged protruding axially in the direction of plugging-in, is made from a resilient metal material in the represented illustrative embodiment, such that the locking elements 6 are of elastic configuration.

The invention claimed is:

1. An electrical circular plug-in connector having a plug part and a counter-plug part, which can be releasably locked together, and respectively having at least one plug-in contact, and having a locking mechanism according to the push-pull principle on the plug side, which mechanism has at least one locking element that extends axially and can be deflected radially, which element is provided with a radially inwardly protruding detent arranged transversely thereto, to which an outwardly open latching trap is assigned on the counter-plug part side, whereby the locking element is capable of actuation by means of an axially displaceable unlocking sleeve supported by the plug part at least in such a way that the detent and the latching trap are capable of moving out of engagement in the course of the displacement of the unlocking sleeve against the direction of plugging-in of the plug part, whereby the at least one locking element is integrally molded on a retaining ring, which on the plug side is mounted on the plug part between the unlocking sleeve and a front hollow cylindrical plug region of a plug part housing of the plug part, whereby the detent has a rear sliding ramp arranged at the rear in the direction of plugging-in of the plug part and the latching trap has an associated inner rear sliding ramp arranged at the rear in the direction of plugging-in of the plug part, and which pulls the plug part and the counter-plug part together in a play-free manner by means of a spring force component acting inwardly in a radial direction, wherein a securing sleeve capable of axial displacement together with the unlocking sleeve for the at least one locking element is arranged between the retaining ring with the at least one molded-on locking element and the unlocking sleeve, whereby the unlocking sleeve is acted upon by a spring force in the direction of plugging-in of the plug part by means of a helical pressure spring, which is supported at the rear on the plug part housing of the plug part, and which acts upon the locking element with a radially inward force by means of a front sleeve section of the securing sleeve, and wherein the securing sleeve in the direction of the plugging-in of the plug part has at the front the front sleeve section inclined outwardly in a radial direction acting as a pressure surface.

2. The plug-in connector as claimed in claim 1, wherein the securing sleeve is molded on the unlocking sleeve.

3. The plug-in connector as claimed in claim 1, wherein the detent has a front sliding ramp arranged at the front in the direction of plugging-in of the plug part, and the latching trap has an associated outer rear sliding ramp arranged at the rear in the direction of plugging-in of the plug part, so that the locking element is capable of being deflected radially outwards.

4. The plug-in connector as claimed in claim 1, wherein the locking element between the detent and the retaining ring has an actuating cam having a sliding flank inclined on the rear side in the direction of plugging-in of the plug part, which extends radially outwards in the direction of the unlocking sleeve, whereby the securing sleeve acts on the sliding flank with the front sleeve section inclined outwards in the radial direction.

5. The plug-in connector as claimed in claim 1, wherein the retaining ring with the at least one molded locking element is an injection-molded component made from a thermoplastic plastic material or a component produced by stamping and bending made from an elastically deformable metal material.

6. The plug-in connector as claimed in claim 1, wherein the at least one locking element of the retaining ring is of self-unlocking configuration, whereby the detent is capable of being snapped into engagement in the latching trap by means of the securing sleeve and of being secured there, when the detent engages at least partially over the latching trap, and of snapping automatically out of engagement from the latching trap when the securing sleeve does not act upon the locking element with the front sleeve section inclined outwards in the radial direction.

7. The plug-in connector as claimed in claim 6, wherein, in conjunction with the movement of the unlocking sleeve against the direction of plugging-in of the plug part, the outwardly swiveling locking element causes the securing sleeve to move over the actuating cam against the direction of plugging-in of the plug part.

8. The plug-in connector as claimed in claim 6, wherein the spring force, which acts upon the unlocking sleeve and/or the securing sleeve in the direction of plugging-in of the plug part, is greater than the radial spring force of the at least one locking element molded on the retaining ring.

9. The plug-in connector as claimed in claim 1, wherein the at least one locking element of the retaining ring is of self-locking configuration, whereby the detent engages automatically in the latching trap and is capable of being secured there by means of the securing sleeve when the detent engages at least partially over the latching trap.

10. The plug-in connector as claimed in claim 9, wherein the actuating cam of the at least one locking element has an unlocking hook open in the direction of the counter-plug part, and the unlocking sleeve has a carrier hook assigned to the unlocking hook, which engages the unlocking hook during movement of the unlocking sleeve away from the counter-plug part.

11. The plug-in connector as claimed in claim 10, wherein the unlocking hook has an unlocking sliding surface inclined towards the counter-plug part, and the carrier hook has an associated unlocking counter-sliding surface inclined away from the counter-plug part, which interact in such a way that, in conjunction with the movement of the unlocking sleeve against the direction of plugging-in of the plug part, the carrier hook causes the unlocking sleeve of the locking element to be deflected radially outwards.

12. The plug-in connector as claimed in claim 10, wherein, in conjunction with the movement of the unlocking sleeve against the direction of plugging-in of the plug part of the unlocking hook as it swivels radially outwards, the securing sleeve moves over the actuating cam against the direction of plugging-in of the plug part.

* * * * *